US005382218A

United States Patent [19]

Uchida

[11] Patent Number: 5,382,218

[45] Date of Patent: Jan. 17, 1995

[54] ROTOR HAVING MAGNET MOUNTABLE SEATS FOR ROTOR IDENTIFICATION, AND CENTRIFUGE USING THE SAME

[75] Inventor: Tadahiro Uchida, Sayama, Japan

[73] Assignee: Kabushiki Kaisha Kubota Seisakusho, Tokyo, Japan

[21] Appl. No.: 170,734

[22] Filed: Dec. 21, 1993

[30] Foreign Application Priority Data

Dec. 28, 1992 [JP] Japan ..... 4-348984

[51] Int. Cl.[6] ..... B04B 13/00

[52] U.S. Cl. ..... 404/10

[58] Field of Search ..... 494/9-11, 494/16; 388/809, 811, 814, 907.5, 912, 933; 318/254; 340/671, 681, 870.34

[56] References Cited

U.S. PATENT DOCUMENTS

| | | | |
|---|---|---|---|
| 3,462,670 | 8/1969 | Waye | 318/327 |
| 4,257,040 | 3/1981 | Shirasaki et al. | 340/671 |
| 4,551,715 | 11/1985 | Durbin | 494/9 X |
| 4,601,696 | 7/1986 | Kamm | 494/10 |
| 4,700,117 | 10/1987 | Giebeler et al. | 494/10 X |
| 4,772,254 | 9/1988 | Grassl et al. | 494/10 |
| 4,827,197 | 5/1989 | Giebeler | 494/9 X |
| 5,037,371 | 8/1991 | Romanauskas | 494/10 |
| 5,221,250 | 6/1993 | Cheng | 494/10 X |
| 5,235,864 | 8/1993 | Rosselli et al. | 494/10 X |
| 5,338,283 | 8/1994 | Fleming et al. | 494/10 |

FOREIGN PATENT DOCUMENTS

| | | | |
|---|---|---|---|
| 3815449 | 11/1989 | Germany . | |
| 334279 | 7/1991 | Japan . | |
| 1604491 | 11/1990 | U.S.S.R. | 494/11 |

*Primary Examiner*—David A. Scherbel
*Assistant Examiner*—Charles Cooley
*Attorney, Agent, or Firm*—Pollock, Vande Sande & Priddy

[57] ABSTRACT

Predetermined magnet mountable seats are provided on the lower portion of a rotor at equal angular intervals around the central axis of the rotor so that magnets may be mounted in one or more of the magnet mountable seats in an array pattern. Various array patterns may be provided by different combinations of presence and absence of magnets depending on the types of rotors. Arranged on a fixed mount in opposing relation with the array of magnet mountable seats are magnetic sensors along a circle around the central axis at angular intervals equal to or smaller than the angular intervals of the magnet mountable seats. A microprocessor identifies the type of rotor by detecting the array pattern of magnets on the basis of detected outputs from the magnetic sensors.

5 Claims, 7 Drawing Sheets

| SENSOR No. | A1 | A2 | A3 | A4 | A5 | A6 | A7 | A8 | A9 | A10 | A11 | A12 |
|---|---|---|---|---|---|---|---|---|---|---|---|---|
| OUTPUT | 1 | 1 | 1 | 1 | 1 | 1 | 1 | 0 | 0 | 0 | 0 | 0 |

| SENSOR No. | B1 | B2 | B3 | B4 | B5 | B6 | B7 | B8 | B9 | B10 | B11 | B12 |
|---|---|---|---|---|---|---|---|---|---|---|---|---|
| OUTPUT | 0 | 0 | 0 | 0 | 0 | 0 | 0 | 0 | 0 | 0 | 0 | 0 |

FIG.6A

| RAM ADDRESS | RA-1 | RA-2 | RA-3 | RA-4 | RA-5 | RA-6 | RA-7 | RA-8 | RA-9 | RA-10 | RA-11 | RA-12 |
|---|---|---|---|---|---|---|---|---|---|---|---|---|
| DATA A | 1 | 1 | 1 | 1 | 1 | 1 | 1 | 0 | 0 | 0 | 0 | 0 |

| RAM ADDRESS | RB-1 | RB-2 | RB-3 | RB-4 | RB-5 | RB-6 | RB-7 | RB-8 | RB-9 | RB-10 | RB-11 | RB-12 |
|---|---|---|---|---|---|---|---|---|---|---|---|---|
| DATA B | 0 | 0 | 0 | 0 | 0 | 0 | 0 | 0 | 0 | 0 | 0 | 0 |

FIG.6B

| RAM ADDRESS | R-1 | R-2 | R-3 | R-4 | R-5 | R-6 | R-7 | R-8 | R-9 | R-10 | R-11 | R-12 |
|---|---|---|---|---|---|---|---|---|---|---|---|---|
| DATA N | 1 | 1 | 1 | 1 | 1 | 1 | 1 | 0 | 0 | 0 | 0 | 0 |

FIG.6C

ROTOR HAVING MAGNET MOUNTABLE SEATS FOR ROTOR IDENTIFICATION, AND CENTRIFUGE USING THE SAME

TECHNICAL FIELD

This invention relates to a centrifuge which is capable of automatically identifying any one of plural types of rotors that is selectively mounted on a rotating shaft of the centrifuge, and also relates to a rotor for use with such centrifuge.

BACKGROUND ART

A typical example of the prior art centrifuge of this type is disclosed in Japanese Patent Publication No. 3-34279, a summary of which will be described below.

FIG. 1A shows a rotor chamber 1 and a motor 7 which form a part of the centrifuge. A housing which accommodates these components is not shown. Mounted to the top end of the rotating shaft 7R within the rotor chamber 1 of the centrifuge is a rotor 2 which is rotatively driven by energizing the motor 7. Mounted to the bottom end of the rotor 2 is an adapter 5 having magnets 6 attached thereto on the same circumference at an interval of rotational angle $\theta$ (FIG. 1B) predetermined depending on the type of rotor.

An annular fixed mount 3 is disposed concentrically around the rotating shaft 7R and has a magnetic sensor 4 mounted in its outer peripheral surface which is in opposed, spaced relation with the inner periphery of the adapter 5. The magnetic sensor 4 is adapted to sense the magnetic flux of the magnets 6 to produce an output signal corresponding to the sensed flux and transmit it to a microcomputer 9 as shown in FIG. 2.

The microcomputer 9 is also provided with an output signal from a rotation sensor or tachometer 8 for sensing the number of revolutions of the motor 7. The microcomputer 9 further determines the operational conditions of the centrifuge such as the number of revolutions per unit time, the time for operation, the time for acceleration, the time for deceleration, the temperature of the rotor, whether the rotor chamber 1 is under vacuum or at an atmospheric pressure, the permissible revolution rate of the rotor itself, etc. to control the operations of an operational condition display 13, the motor 7, a refrigerator 14 and other devices 15 by storing in a RAM 12 or taking out from the RAM the operational data as preset by an operational condition setting device 16, in accordance with a centrifuge controlling program stored in a ROM 11.

Upon the operator depressing a start switch 10, the microcomputer 9 outputs a signal of acceleration to the motor 7 to start rotating it whereupon the magnetic sensor 4 detects the magnetic flux and transmits a corresponding output signal to the microcomputer 9. The microcomputer 9, which has been supplied with signals from the rotation sensor 8 and the magnetic sensor 4, is in turn capable of identifying the type of the associated rotor by calculating the angular spacing $\theta$ between two magnets on the basis of the pulse period Tr per revolution of the rotor and the interval $T\theta$ between pulses. If an adapter 5 having a particular mounting angle $\theta$ peculiar to a particular type of rotor 2 is employed, the microcomputer 9 is able to identify the type of the rotor by determining the angle $\theta$ formed between the adjacent magnets 6 peculiar to said rotor. Accordingly, the data of the operational conditions for each type of rotor are stored in the RAM 12, and the microcomputer 9 will identify the type of rotor by the value of $\theta$ and read out the data of the operational conditions for the particular type of rotor to thereby automatically control the operation of the centrifuge.

The conventional centrifuge is equipped with only one magnetic sensor 4 for sensing the magnetic flux of the magnets 6, so that the rotor 2 cannot be identified unless it is rotated. That is, the procedures are in such an order that, when the rotor starts to rotate, the type of the rotor is automatically identified by the centrifuge, the operational conditions are determined on the basis of the operational data (stored in the RAM of the centrifuge) and the operational conditions are indicated on the display 13. The operator cannot know that a wrong rotor is being used before he takes a look at the display. In that case, as the rotor is already rotating, the operator has to turn off the start switch 10 and wait until the rotor 2 stops rotating. The use of a wrong rotor thus results in an undesirable loss in time.

The German Patent Application Publication DE 3815449A1 also discloses a centrifuge capable of automatically identifying the type of rotor. In this apparatus, magnets are arranged on the bottom surface of a rotor along a defined circle at predetermined equal angular intervals and in a polar array defined depending on the type of the rotor, and a single magnetic sensor is disposed at a fixed position opposing and spaced from said circle. The arrangement is such that the type of rotor may be identified in accordance with a bit pattern of "0's" and "1's" detected as the rotor rotates. However, this apparatus is also unable to identify the type of rotor while the rotor is at a standstill, as is the case with the prior Japanese art example as described above.

SUMMARY OF INVENTION

It is an object of this invention to provide a centrifuge in which the type of rotor mounted on the centrifuge can be automatically identified even before the rotation of the rotor is initiated.

It is another object of this invention to provide a rotor for use with such a centrifuge.

In the centrifuge according to this invention, predetermined magnet mountable seats are provided on the lower portion of a rotor at equal angular intervals around the central axis of said rotor so that magnets may be mounted in one or more of the magnet mountable seats in an array pattern. Various array patterns may be provided by different combinations of presence and absence of magnets depending on the types of rotor. Arranged on a fixed mount in opposing relation with the array of magnet mountable seats are magnetic sensors along a circle around the central axis at angular intervals equal to or smaller than the angular intervals of the magnet mountable seats. The type of rotor may be identified by processing outputs from said magnetic sensors while said rotor is at a standstill.

BRIEF DESCRIPTION OF THE DRAWINGS

FIG. 6A shows the output data A of the magnetic sensors 4 shown in FIG. 5D;

FIG. 6B shows a pattern (data) of magnet array written in the RAM by a microcomputer on the basis of the output data of the sequence A;

FIG. 6C shows data obtained by taking a logic OR between the data in the upper and lower rows;

THE PREFERRED EMBODIMENTS OF THE INVENTION

Figure 1A:
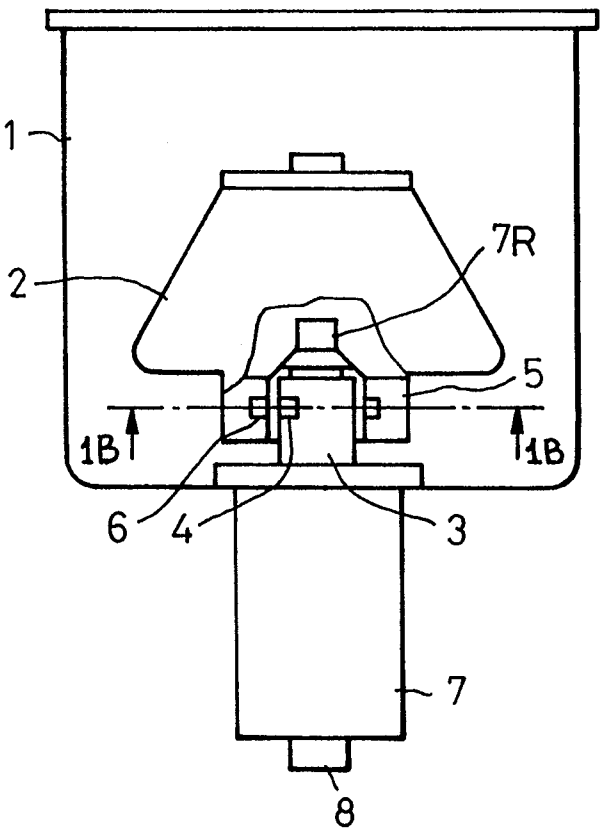
FIG. 1A PRIOR ART
FIG. 1A is a schematic partially cutaway front view illustrating a prior art centrifuge.
Figure 1B:
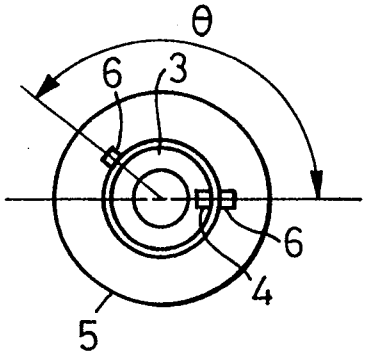
FIG. 1B PRIOR ART
FIG. 1B is a transverse cross-sectional view of the centrifuge taken in line 1B—1B of FIG. 1A.
Figure 1C:
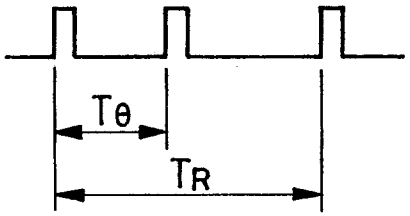
FIG. 1C PRIOR ART
FIG. 1C is a diagram showing the output of the magnetic sensor shown in FIG. 1B.
Figure 2:
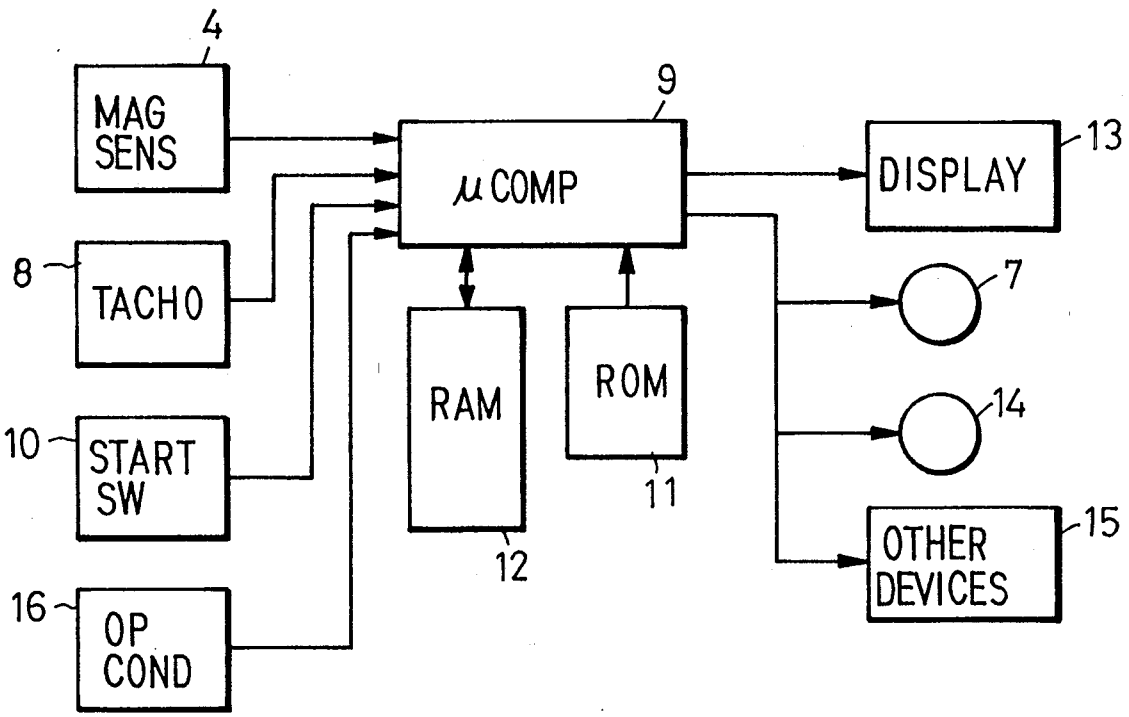
FIG. 2 PRIOR ART
FIG. 2 is an electronic block diagram for the centrifuge shown in FIG. 1A.

One embodiment of the this invention is shown in FIGS. 3A–3D, in which parts corresponding to those in FIGS. 1A, 1B and 2 are indicated by the same reference numbers.

Figure 3A:
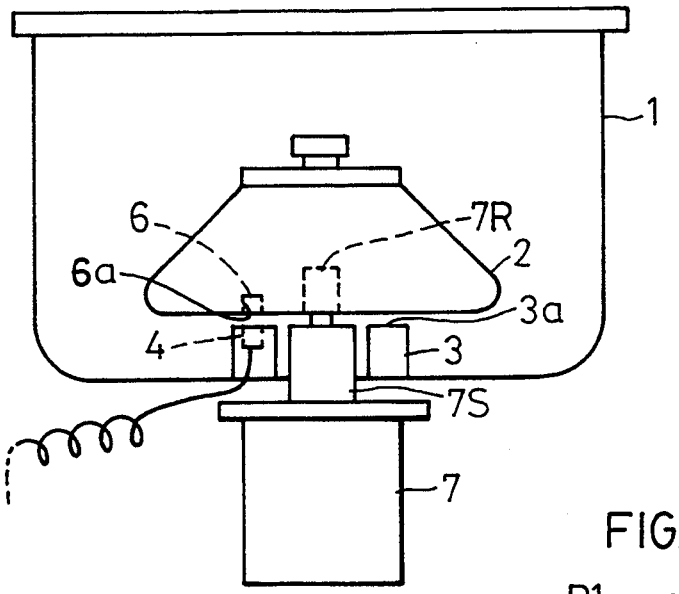
FIG. 3A is a schematic front view of a centrifuge according to one embodiment of this invention.

FIG. 3A shows a rotor chamber 1, a rotor 2, a motor 7 and other components of a centrifuge according to this invention, but a housing which accommodates these components is not shown. The motor 7 is disposed within the housing (not shown) of the centrifuge with its rotating shaft 7R vertically oriented. The upper end of the rotating shaft or rotor shaft 7R extends into the rotor chamber 1 through the center of the bottom thereof and a sleeve 7S. Within the rotor chamber 1 the rotor 2 is detachably mounted to the top end of the rotating shaft 7R.

In this embodiment, an annular fixed mount 3 is disposed surrounding the sleeve 7S and secured to the bottom of the rotor chamber 1. The upper annular end face **3*a* of the fixed mount 3 is in opposed spaced relation with the bottom surface of the rotor 2. A predetermined number of magnetic sensors 4 mounted in the upper annular end face 3*a* of the fixed mount 3 at angularly equally spaced locations along a circle concentric of the rotating shaft 7R. Embedded in the bottom surface of the rotor 2 along a circle axially opposing the circular array of magnetic sensors 4 are one or more magnets 6** at angular locations defined depending on the type of rotor as will be described hereinbelow.

In this embodiment, the bottom surface of the rotor 2 has predetermined angularly equally spaced magnet mountable positions around a circle at a predetermined radius from the central axis of the rotor. Formed in the bottom surface at each of the magnet mountable positions is a seat such as a recess **6*a* complementarily shaped so as to receive a magnet 6. A number of magnets 6 may be mounted in some of the magnet mountable seats or recesses 6*a* in a particular array pattern preselected depending on the type of rotor such that the exposed faces of the magnets are flush with the bottom surface of the rotor. As stated above, in the upper annular end face 3*a* of the fixed mount 3 opposing and axially spaced from the circular array of magnets 6 a multiplicity of magnetic sensors 4 are mounted around the entire circle concentric of the axis of the rotor 2 at equal angular intervals equal to 1/n (where n is a positive integer) of the equal angular spacings of the magnet mountable seats. The microcomputer 9** identifies the type of the rotor by processing the output of the magnetic sensors while the rotor is at a standstill in a manner as will be described below.

Figure 3B:
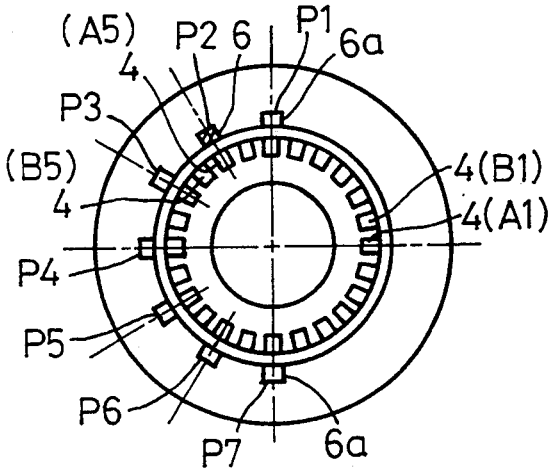
FIGS. 3B and 3C are views illustrating the relative angular positions between the magnetic sensors 4 and the magnets 6 in another phase of movement.
Figure 3C:
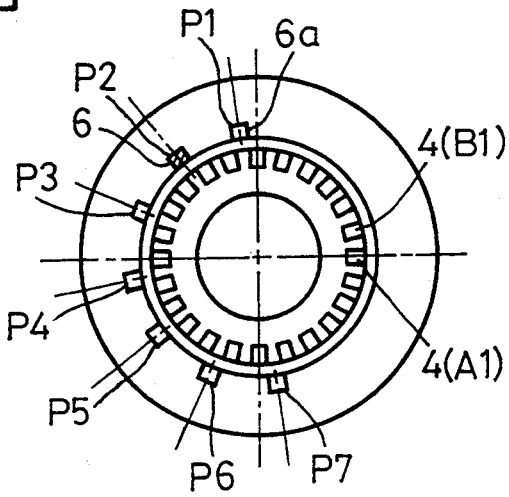

FIGS. 3B and 3C illustrate the magnetic sensors 4 and the magnet mountable seats P1–P7 for magnets 6 which are actually lying on two axially spaced apart circles at the same radius from the axis of the rotating shaft 7R as lying on two concentric circles in the same plane but having different radii for the benefit of clearly illustrating the rotational angular positions between the magnetic sensors 4 and the magnet mountable seats.

It is possible, of course, within the scope of this invention to dispose an annular adapter 5 or an annular lower portion depending from the rotor 2, and to mount magnets 6 in the inner periphery of the annular adapter 5 or the annular lower portion, and to arrange magnetic sensors 4 around the inner periphery of a cylindrical fixed mount 3 which is disposed within the inner periphery of the adapter, as illustrated in FIG. 1B. In that case, the magnets 6 and the magnetic sensors 4 are in radially opposed relation.

The rotor 2 is not in a fixed rotational relation relative to the rotating shaft 7R, so that the rotor may be secured to the rotating shaft 7R in any relative rotational relation as exemplified in FIGS. 3B and 3C.

Figure 4A:
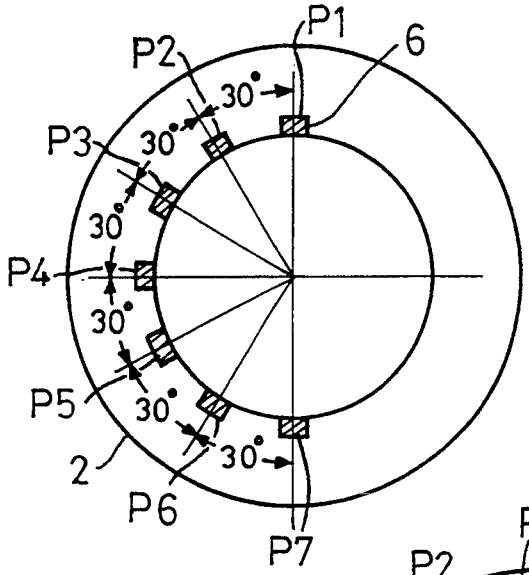
FIG. 4A is a view illustrating an example of the array of magnets 6.
Figure 4B:
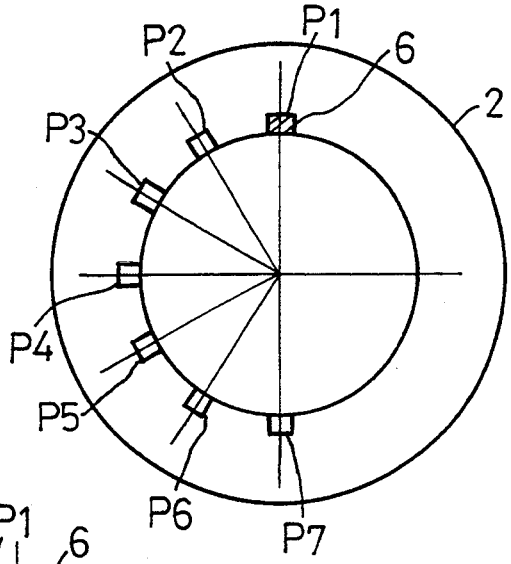
FIG. 4B is a view illustrating another example of the array of magnets 6.

In the illustrated embodiment, as shown in FIGS. 3B, 4A and 4B, for example, the detectability of the magnets 6 irrespective of the rotational angular position in which the rotor is secured to the rotating shaft 7R may be enhanced by making the angular pitch of the magnetic sensors 4 one half the angular pitch of the magnet mountable seats. Further in this embodiment, the magnetic sensors 4 arranged on the upper end face **3*a* of the annular fixed mount B around a predetermined full circle are divided, as shown in FIG. 4D, into two series sensor groups, i.e. the group A of sensors A1–A12 and the group B of sensors B1–B12**, one of the groups comprising every second sensor selected from all the sensors and the other group comprising every second sensor other than the sensors of the one group, so that the type of rotor may be identified on the basis of the outputs obtained by taking a logical OR between the outputs of the group A sensors and the group B sensors, whereby the reliability in identifying the rotor type is improved.

In general, if the angular pitch of the magnetic sensors 4 is 1/n (where n is a positive integer) of the angular pitch of the magnet mountable seats, the detectability of the array pattern of magnets 6 in any rotational angular position in which the rotor is secured to the rotating shaft 7R may be enhanced. In addition, the reliability of the pattern to be detected is improved if the magnetic sensors 4 in the array are divided into n series sensors by selecting n series of sensors, each series comprising every nth sensor selected from the sensors on the array but other than the sensors of any other series, so that a logical OR may be taken at the positions corresponding to the outputs of the n series to be detected. However, this invention is not intended to be limited to dividing the sensors into n groups.

At most seven magnets 6 may be mounted at predetermined positions P1–P7 spaced apart by 0° to 180° (30° in the illustrated embodiment). One hundred and twenty-eight types of rotors may be identified by combinations of the presence and absence of magnets 6 at the positions P1–P7 spaced apart by 30°. FIG. 4A shows an example where the maximum of seven magnets 6 are used while FIG. 4B shows an example where minimum one magnet 6 is used. However, possible combinations are reduced to sixty-three if the following conditions are added:

Condition 1

A magnet must be mounted at position P1 for any type of rotor.

Condition 2

Figure 4C:
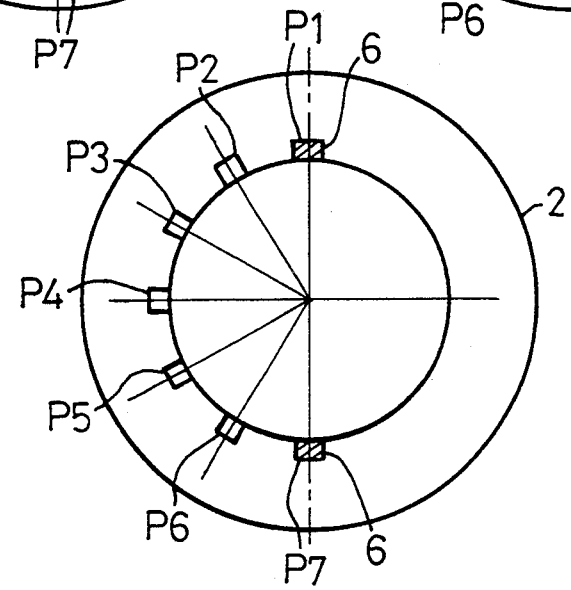
FIG. 4C is a view illustrating yet another example of the array of magnets 6.
Figure 4D:
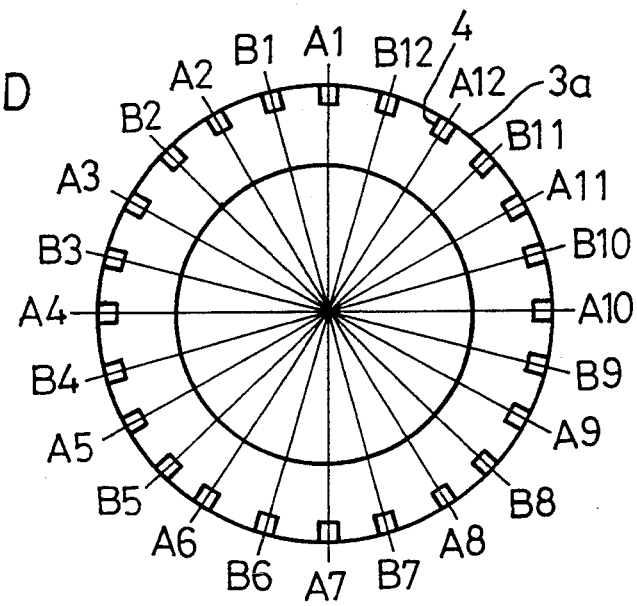
FIG. 4D is a view illustrating an example of the array of magnetic sensors 4.

Any combination comprising only two magnets 180° spaced apart as shown in FIG. 4C should not be used.

Twenty-four magnetic sensors 4 are arranged as shown in FIG. 4D. Specifically, the magnetic sensors A1–A12 and B1–B12 are arranged on the annular face 3*a* of the mount 3 in a circular array at intervals of 15° around the rotating shaft. The magnetic sensors 4 of the group A and the group B are connected with input terminals a1–a12 of a multiplexer Ma and input terminals b1–b12 of a second multiplexer Mb, respectively.

Figure 5A:
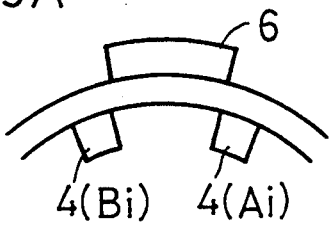
FIG. 5A is a view illustrating the relative angular positions between the magnetic sensors 4 and the magnets 6 in a phase of movement.
Figure 5C:
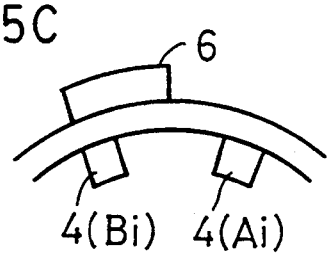
FIG. 5C is a view illustrating the relative angular positions between the magnetic sensors 4 and the magnets 6 in still another phase of movement.
Figure 5B:
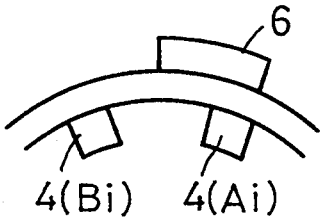
FIG. 5B is a view illustrating the relative angular positions between the magnetic sensors 4 and the magnets 6 in another phase of movement.

The relationship between the magnitude of magnetic force of the magnets 6 and the sensitivity of the magnetic sensors 4 is such that the magnet 6 mounted at any of the positions P1–P7 will provide a magnetic force sufficient to supply an output to both the magnetic sensors 4 (Ai) and 4 (Bi) when the magnet is at a midpoint between adjacent sensors as shown in FIG. 5A and that the magnetic sensors have a sensitivity sufficient to sense such output. Further, said relationship is such that when the magnet is closer to the magnetic sensor 4 (Ai) than to the magnetic sensor 4 (Bi) as shown in FIG. 5B, only the magnetic sensor 4 (Ai) can supply an output, and that when the magnet is closer to the magnetic sensor 4 (Bi) than to the magnetic sensor 4 (Ai) as shown in FIG. 5C, only the magnetic sensor 4 (Bi) can supply an output.

In addition, the arrangement is such that the magnet 6 at the position P1 has a magnetic force greater than the magnets 6 at the positions P2–P7. More specifically, the magnet 6 at the position P1 will provide a magnetic force sufficient to supply an output to both the magnetic sensors 4 (Ai) and 4 (Bi) when said magnet is at a midpoint between adjacent sensors as shown in FIG. 5A and that when the magnet at position P1 is closer to the magnetic sensor 4 (Ai) than to the magnetic sensor 4 (Bi), only the magnetic sensor 4 (Ai) can supply an output, as is the case with the magnets 6 at the positions P2–P7. But, since the magnet 6 at the position P1 has a magnetic force greater than the magnets 6 at the positions P2–P7, outputs may be provided at both of the two magnetic sensors even if the magnet 6 at the position P1 is displaced from the midpoint to a greater extent than in the case of the magnets 6 at the positions P2–P7. Consequently, the magnet 6 at the position P1 has a greater extent of space in which it may be sensed by the magnetic sensor than the magnets at the positions P2–P7. Alternatively, similar effects may be obtained by employing a magnet having a larger dimension along the circumference of the rotor instead of a greater magnetic force as a magnet for the position P1.

The rotor 2 is inserted over and secured to the rotating shaft 7R as shown in FIG. 3A. As stated before, the rotational angular position in which the rotor 2 is attached to the rotating shaft 7R is arbitrary and there is no fixed angular position. In other words, it is not definite to which of the magnetic sensors A1–A12 and B1–B12 the magnet at the position P1 in FIGS. 4A and 4B is to be closest.

Figure 5D:
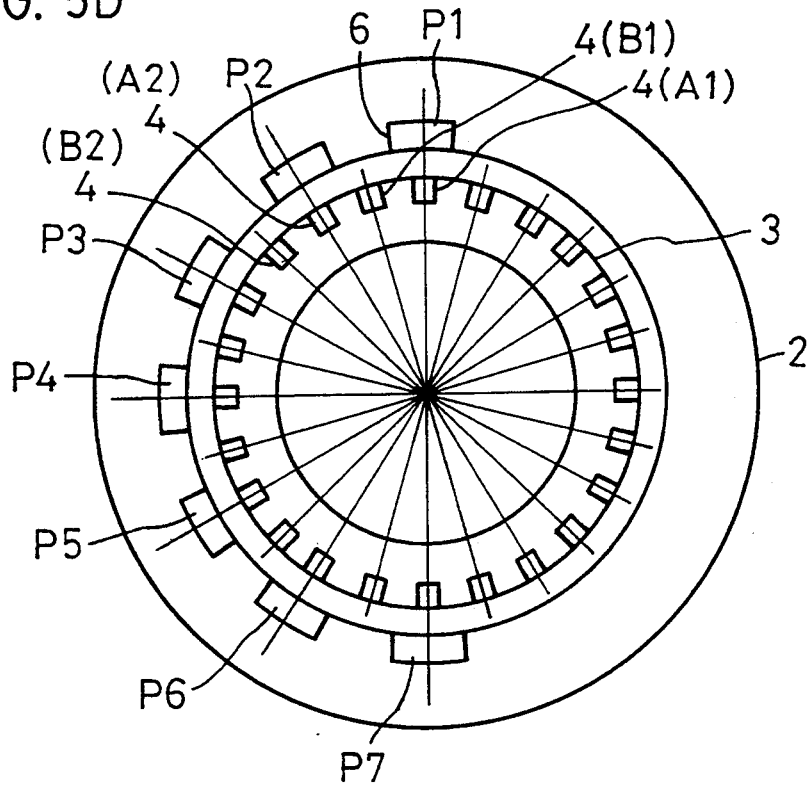
FIG. 5D is a view illustrating an example of the relative positions between the magnetic sensors 4 and the magnets 6.

Let it be assumed that an output signal produced as a detected output at a magnetic sensor 4 by a magnet 6 approaching the magnetic sensor 4 be high level "1" and that an output signal produced as no detected output be low level "0". FIG. 5D illustrates an embodiment in which the rotor 2 having an array of seven magnets shown in FIG. 4A is combined with the magnetic sensors 4 as shown in FIG. 4D, wherein the magnet at the position P1 happens to be closest to the magnetic sensor 4 (A1). In this state, the outputs of the magnetic sensors A1–A7 are all at level "1" while all the other magnetic sensors A8–A12 and B1–B12 are at level "0".

Figure 3D:
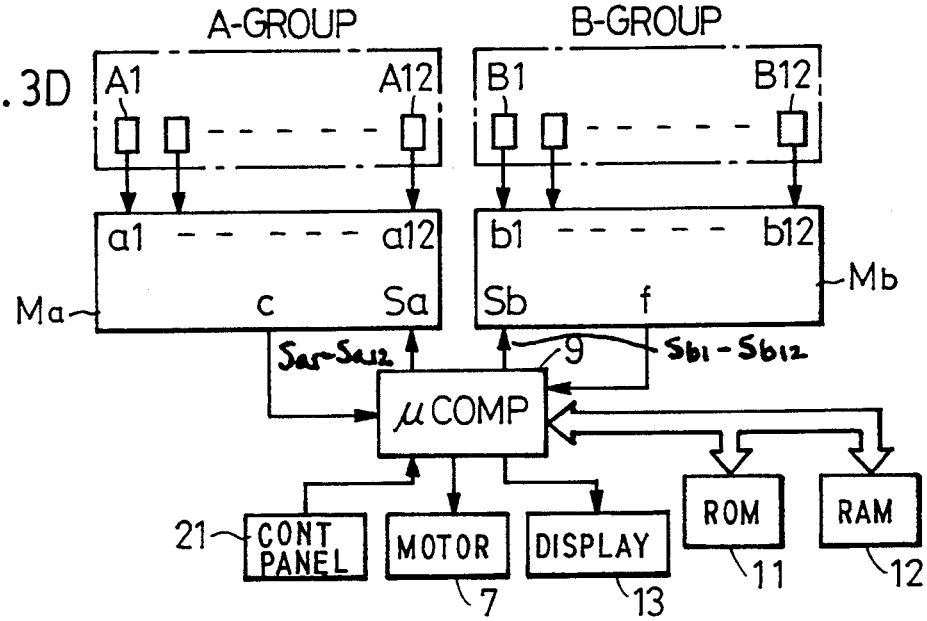
FIG. 3D is an electronic block diagram for the centrifuge according to the embodiment of this invention.

The microcomputer 9 shown in FIG. 3D produces and provides select signals Sa1–Sa12 successively in a cycle to the select terminal Sa of the multiplexer Ma to select the input terminals a1–a12 of the multiplexer Ma, whereby the output signals from the magnetic sensors A1–A12 as shown in FIG. 6A are successively selected and provided through the output terminal c.

The microcomputer 9 analyzes the output data from the multiplexer Ma and stores them in the cells of the RAM 12 at addresses RA-1 to RA-12 as follows. First, the microcomputer 9 determines whether among the data input therein the data following five consecutive "0's" is "1" or not. If said data is "1", the microcomputer will store said data in the RAM 12 at address RA-1, and the succeeding data in the RAM 12 at addresses RA-2 to RA-12 in this order. While there are 12 bit data, the twelfth data is handled as data continuing, in the form of a ring, back to the first data.

If said data is "0", the microcomputer 9 will continue reading the succeeding data until it meets with "1", whereupon it will handle the data "1" as the first data and store it in the RAM 12 at address RA-1, and will store the succeeding data in the RAM 12 at addresses RA-2 to RA-12 in that order. When all the 12 bits of data are "0", the data "0" are stored at all of the addresses A-1 to RA-12. Once the microcomputer 9 has written the 12 bits of data in the addresses A-1 to RA-12, it stops supplying the select signals to the select terminal Sa.

Next, the microcomputer 9 produces and provides select signals Sb1–Sb12 successively in a cycle to the select terminal Sb of the multiplexer Mb to select and provide the output signals from the magnetic sensors B1–B12 as shown in FIG. 6A successively through the output terminal f. The microcomputer 9 then stores the output data from the multiplexer Mb in the RAM 12 at addresses RB-1 to RB-12 in the same manner as described above.

In this manner, the output data of the sensors A1–A12 of the group A and the sensors B1–B12 of the group B as shown in FIG. 6A are stored in the RAM 12 at addresses RA-1 to RA-12 and RB-1 to RB-12 as shown in FIG. 6B. The data at addresses RA-1 to RA-12 and the data at addresses RB-1 to RB-12 will be called "data string A" and "data string B", respectively.

The microcomputer 9 further takes a logic "OR" between the corresponding bits of the data string A and data string B, and stores the resultants in the RAM 12 at new addresses R-1 to R-12 as shown in FIG. 6C. These data will be called "data string N".

Stored as a reference table in the ROM 11 of the microcomputer 9 are data strings for various types of rotors which may be obtained from the array of magnets predetermined for each of the various types of rotors. The microcomputer 9 check the data string N with the data strings corresponding to the various types of rotors to seek the same data string as said data string N to thereby identify the type of the rotor concerned.

Figure 7A:
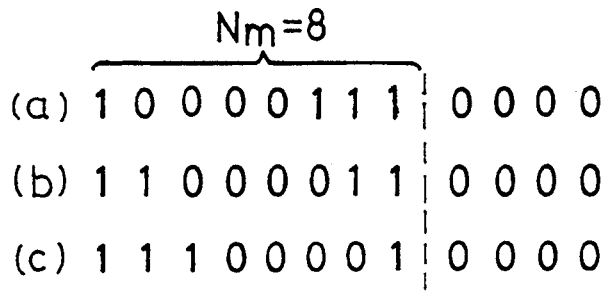
FIG. 7A shows patterns of magnet array which are to be prohibited when the maximum number Nm of magnets=8.

As is apparent from the foregoing description, what is of importance in identifying the array of magnets is from which of the sensors the output signal is assumed to be the leading data or first place data of the data string N. While in the illustrated embodiment, the maximum number Nm of magnets to be attached to the rotor 2 equals 7 and the data "1" following five (12−Nm) or more consecutive "0's" is assumed to be the leading data of the data string N, these conditions will vary depending on the maximum number Nm of magnets to be attached to the rotor 2. For example, if the maximum number Nm of magnets is 6, then the data "1" following six (12−Nm) or more consecutive "0's" may be assumed to be the leading data of the data string N. If the maximum number Nm of magnets is 8, then the data "1" following four (12−Nm) or more consecutive "0's" is assumed to be the leading data of the data string N. In the latter case, however, arrays such as arrays (a), (b) and (c) shown in FIG. 7A in which there are four consecutive "0's" among the most significant eight bits corresponding to an array of eight successive magnets should be excluded from usable arrays because in such arrays it cannot be determined which of the data "1" preceded by four "0's" is the leading data. Such exclusion would present no problem since there are a great number of other usable arrays.

Figure 7B:
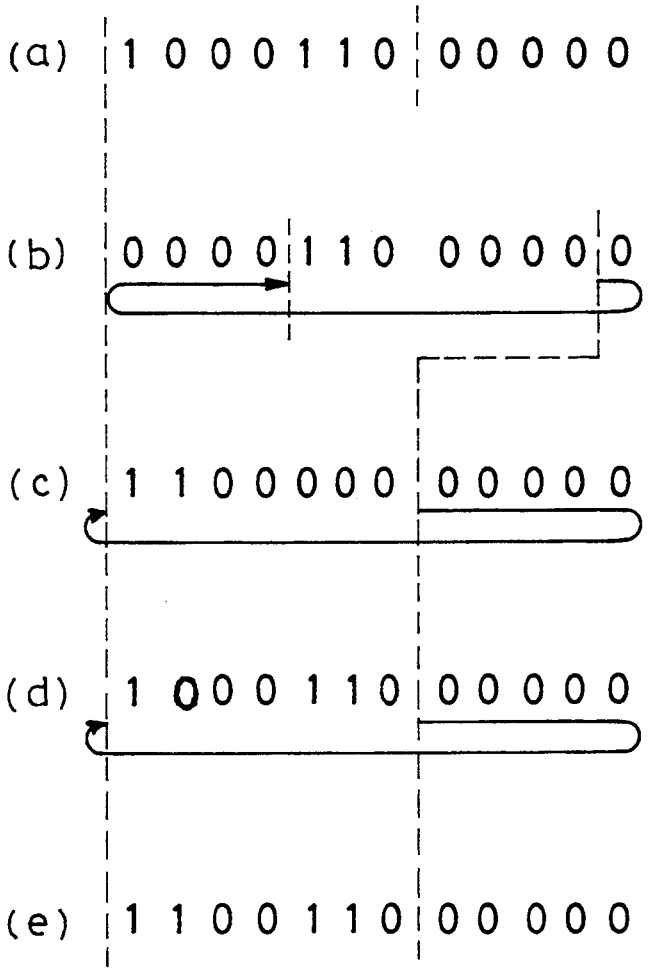
FIG. 7B shows the relation between a pattern (a) of output data from the illustrated array of magnets, a pattern (b) of output data of the group A sensors corresponding to the pattern (a) containing output errors, a data pattern (c) obtained by writing the data pattern (b) in the RAM by the microcomputer, a pattern (d) of output data of the group B sensors corresponding to the pattern (a), and a pattern (e) of outputs obtained by taking a logical OR between the patterns (c) and (d).

If there is a pattern in which signals from the magnets corresponding to the second and less significant bits are read able but a signal from the magnet corresponding to the most significant bit (MSB) is not available, the most significant bit must have been displaced out of the pattern. Then, taking a logic OR could not provide a correct pattern. In the magnet array from which a pattern such as the data string (a) shown in FIG. 7B should be obtained, let it be assumed, by way of example, that only the first place magnet corresponding to the MSB could not be detected among the sensors of the group A. In that case, the pattern would be as shown in FIG. 7B(*b*). The microcomputer 9 would then interpret the pattern (b) as signals shown in a pattern (c) since the condition is set for the microcomputer 9 that the data "1" following five or more consecutive "0's" be assumed to be the MSB data. However, owing to the arrangements being such that any single magnet can be detected by at least one or two magnetic sensors even if the sensors of the group A fail to make correct reading, the sensors of the group B can read correctly. A correct pattern (d) can thus be produced. It should be noted here that if a logic OR is taken between the patterns (c) and (d) from the sensor groups A and B, respectively, a pattern (e) different from the correct pattern (a) would be produced.

This problem may be overcome, according to the teachings of this invention, by increasing either the size or the magnetic force of the magnet only at the first place P1, that is, the position P1 as indicated above so as to insure that the first place magnet may be detected. As long as the first place magnet is detected correctly, a correct signal pattern may be obtained by taking a logic OR between the signals from the sensor groups A and B.

In the case that the first place magnet may not be detected by the sensors of one of the two groups, the signals from the magnets at the second place et seq. P2–P7 would be all "0" since the signals from the second place and succeeding magnets are smaller in size or magnetic force than the first place magnet, but the signals may be corrected by taking a logic OR as the signals may be completely read by the sensors of the other group.

While the number of consecutive "0's" for identifying the leading data varies depending on the total number of sensors 4, the manner in which the type of rotor is identified is the same.

While the data "1" is read following several consecutive "0's" in the illustrated embodiment described above, it will be apparent to one skilled in the art that it is within the scope of this invention to replace "1's" with "0's".

It is also within the scope of this invention to use a particular pattern comprising a combination of "1" and "0" and make the data following said particular pattern the leading data.

Once the microcomputer 9 has identified the type of rotor without the need for rotating the rotor, the microcomputer immediately displays on the display 13 the name or number of the rotor and all the information about the rotor such as the maximum number of revolution, the maximum centrifugal force, the rate of acceleration, the rate of deceleration, etc. on the basis of the operating data stored in the RAM, whereby the operator can set the proper centrifugal conditions as by the use of a control panel 21. Alternatively, it is possible to have the microcomputer 9 itself set the centrifugal conditions on the basis of the operating data to permit automatic operation while displaying the conditions on the display.

As is described hereinabove, the type of rotor may be identified while the rotor is stationary according to this invention. However, if the rate at which the connection with the multiplexers Ma and Mb is switched is sufficiently higher than the speed of rotation of the rotor 2 as during the start of rotation of the rotor, the array pattern of the magnets may be correctly detected even if the rotor is rotating, whereby it is possible to perform the operation of identifying the rotor. Alternatively, upon the rotation of the rotor being initiated, a select signal may be provided to either one of the multiplexers Ma and Mb to select and connect one predetermined input terminal with either the output terminal c or f, so that the type of rotor may be identified in the same manner as the conventional manner by employing a pattern of pulses successively output from the multiplexer Ma or Mb simultaneously with rotation of the rotor.

Furthermore, while patterns corresponding to types of rotors are defined according to the presence and absence of magnets at a predetermined number of magnet mountable seats in the illustrated embodiment described above, it will be apparent that it is also possible to mount magnets at all of the magnet mountable seats such that those magnets are arranged in a desired pattern in terms of the orientation of the polarity of the magnets and have magnetic sensors 4 detect the pattern as positive or negative signals or "1" or "0" signals depending on the polarity of the magnets.

In this invention, a plurality of magnets 6 are mounted along a circle on each rotor in an array pattern peculiar to the type of said rotor while magnetic sensors 4 are mounted at equally angularly spaced positions along a circle on the fixed mount (in either axially or radially opposed, closely spaced relation with the circular array of magnets on the rotor) around the rotor shaft. The microcomputer 9 insures that the type of the rotor to be used may be identified before it is started to rotate by taking in the outputs of the sensors and processing the signals to extract binary data. Then, the microcomputer is capable of displaying on the display the operational data prestored in the RAM prior to the initiation of rotation of the rotor. When the operator notices that he or she has mounted a wrong type of rotor, he or she can immediately replace it with a right one as the rotor is at a standstill, thereby substantially reducing the loss time as compared with the prior art.

Having thus described my invention, I claim:

1. A centrifuge comprising:

a rotor having a central axis and a lower portion, said rotor having a plurality of magnet mountable seats arranged on said lower portion at equal angular intervals along a circle around the central axis, each of the magnet mountable seats being adapted to receive one magnet;

a magnet mounted in at least one of said magnet mountable seats, presence and absence of magnets in the respective magnet mountable seats being arranged in an array pattern peculiar to the type of said rotor;

a plurality of magnetic sensors mounted in opposing, spaced relation to said circle along which said magnet mountable seats are provided, said magnetic sensors being arrayed and fixed at equal angular intervals equal to 1/n the equal angular intervals of the magnet mountable seats, where n is a positive integer satisfying $n \geqq 2$, every nth one of said magnetic sensors defining one of n series of magnetic sensors;

n data selecting means adapted to be supplied with outputs from said n series of magnetic sensors;

logical OR means for taking a logical OR of the outputs of said n data selecting means at corresponding positions thereof to determine the array pattern; and processing means for identifying the type of said rotor on the basis of said array pattern.

2. A centrifuge comprising:

a rotor having a central axis and a lower portion, said rotor having a plurality of magnet mountable seats arranged on said lower portion at equal angular intervals along a circle around the central axis, each of the magnet mountable seats being adapted to receive one magnet;

a magnet mounted in at least one of said magnet mountable seats, presence and absence of magnets in the respective magnet mountable seats being arranged in an array pattern peculiar to the type of said rotor;

a plurality of magnetic sensors mounted in opposing, spaced relation to said circle along which said magnet mountable seats are provided, said magnetic sensors being arrayed and fixed at equal angular intervals which do not exceed the equal angular intervals of the magnet mountable seats, said magnetic sensors being alternately grouped into first and second groups;

logical OR means for taking a logical OR between outputs of said first and second groups of the magnetic sensors; and processing means for identifying the type of said rotor on the basis of the outputs of said logical OR means.

3. The centrifuge according to claim 1 or 2, wherein said lower portion is a bottom surface of the rotor, at least two magnets being mounted, respectively, in two of said magnet mountable seats on said bottom surface of said rotor, one of said at least two magnets having a magnetic force greater than the other magnet.

4. A rotor for use with a centrifuge, said rotor having a central axis of rotation and a bottom surface in which a plurality of magnet mountable recesses are formed, said recesses being arranged in an array at predetermined equal angular intervals along an arc of a circle concentric with said central axis of rotation; and at least two magnets mounted respectively in two of said recesses selected according to an array pattern peculiar to the type of said rotor, one of said recesses being a recess at one end of said array, the magnet mounted in the recess at said one end of said array having a magnetic force greater than that of the other of said at least two magnets.

5. A rotor for use with a centrifuge, said rotor having a central axis of rotation and a bottom surface in which a plurality of magnet mountable recesses are formed, said recesses being arranged in an array at predetermined equal angular intervals along an arc of a circle concentric with said central axis of rotation; and at least two magnets mounted respectively in two of said recesses selected according to an array pattern peculiar to the type of said rotor, one of said recesses being a recess at one end of said array,the magnet mounted in the recess at said one end of said array having a dimension, as measured in a circumferential direction, that is larger than that of the other of said at least two magnets.

* * * * *